US011434700B2

(12) United States Patent
Al-Meqbel et al.

(10) Patent No.: US 11,434,700 B2
(45) Date of Patent: Sep. 6, 2022

(54) DISCONNECTING A STUCK DRILL PIPE

(71) Applicant: Saudi Arabian Oil Company, Dhahran (SA)

(72) Inventors: Ali Nasser Al-Meqbel, Riyadh (SA); Abdulrahman M. Al-Musare, Dhahran (SA); Fahad M. Al-Qahtani, Khafji (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/109,679

(22) Filed: Dec. 2, 2020

(65) Prior Publication Data

US 2022/0170329 A1 Jun. 2, 2022

(51) Int. Cl.

| | |
|---|---|
| ***E21B 17/06*** | (2006.01) |
| ***E21B 17/042*** | (2006.01) |
| ***E21B 31/00*** | (2006.01) |

(52) U.S. Cl.

CPC ..... *E21B 17/06* (2013.01); *E21B 17/042* (2013.01); *E21B 31/00* (2013.01)

(58) Field of Classification Search

CPC ..... E21B 17/06; E21B 17/042; E21B 31/00; E21B 31/002

See application file for complete search history.

(56) References Cited

U.S. PATENT DOCUMENTS 3,355,192 A * 11/1967 Kloesel, Jr. ..... E21B 17/042 285/94
3,586,353 A * 6/1971 Lorenz ..... F16B 33/02 285/334

(Continued)

FOREIGN PATENT DOCUMENTS

| | | |
|---|---|---|
| GB | 2528126 | 1/2016 |
| WO | WO 2003048501 | 6/2003 |

(Continued)

OTHER PUBLICATIONS

Oilfield.com [online], "Saver Sub," Oilfield Glossary, available on or before Jan. 23, 2013 via Internet Archive: Wayback Machine URL <https://web.archive.org/web/20130123125645/https://glossary.oilfield.slb.com/en/Terms/s/saver_sub.aspx>, retrieved on Jan. 27, 2021 from URL <https://glossary.oilfield.slb.com/en/Terms/s/saver_sub.aspx>, 2 pages.

(Continued)

*Primary Examiner* — David Carroll
(74) *Attorney, Agent, or Firm* — Fish & Richardson P.C.

(57) ABSTRACT

A drill pipe assembly includes a first drill pipe and a second drill pipe disposed in a wellbore. The first drill pipe includes a tubular wall and a threaded end at a downhole end of the tubular wall. The second drill pipe is disposed in the wellbore downhole of and fluidically coupled to the first drill pipe. The second drill pipe includes a tubular wall and a threaded end corresponding with and configured to receive the threaded end of the first drill pipe to form a connection. At least one of the first drill pipe or the second drill pipe includes an annular groove residing between a respective tubular wall and a respective threaded end. The drill pipe assembly is collapsible at the annular groove under a torque smaller than a torque required to collapse the connection.

12 Claims, 6 Drawing Sheets

(56) References Cited

U.S. PATENT DOCUMENTS

| | | | | |
|---|---|---|---|---|
| 5,323,853 | A | 6/1994 | Leismer et al. | |
| 5,355,968 | A | 10/1994 | Smith et al. | |
| 5,358,285 | A | 10/1994 | Wilson | |
| 5,718,291 | A | 2/1998 | Lorgen et al. | |
| 5,984,029 | A | 11/1999 | Griffen et al. | |
| 6,269,883 | B1 | 8/2001 | Gissler et al. | |
| 6,478,344 | B2 | 11/2002 | Pallini et al. | |
| 8,132,627 | B2 | 3/2012 | Braddick | |
| 8,297,365 | B2 | 10/2012 | Dove | |
| 8,479,827 | B2 | 7/2013 | Davis | |
| 2004/0262004 | A1* | 12/2004 | Roberts | E21B 17/021 166/301 |
| 2005/0024231 | A1 | 2/2005 | Finchet et al. | |
| 2005/0178586 | A1* | 8/2005 | Livingstone | E21B 34/066 175/317 |
| 2006/0214421 | A1* | 9/2006 | Muradov | E21B 17/16 285/333 |
| 2019/0003265 | A1 | 1/2019 | McLaughlin | |
| 2021/0164299 | A1* | 6/2021 | Fong | E21B 17/06 |

FOREIGN PATENT DOCUMENTS

| | | | | |
|---|---|---|---|---|
| WO | WO 2014185912 | | 11/2014 | |
| WO | WO-2020030904 | A1 * | 2/2020 | E21B 17/021 |

OTHER PUBLICATIONS

PCT International Search Report and Written Opinion in International Appln. No. PCT/US2021/061608, dated Mar. 4, 2022, 14 pages.

* cited by examiner

DISCONNECTING A STUCK DRILL PIPE

FIELD OF THE DISCLOSURE

This disclosure relates to wellbore operations, in particular, wellbore drilling operations.

BACKGROUND OF THE DISCLOSURE

During drilling operations, a drill pipe can get stuck in the wellbore, for example, due to pressure differentials at a downhole location of the wellbore or due to mechanical issues. A drill pipe is considered stuck if the pipe cannot be retrieved or freed from the wellbore without damaging the pipe. Pipe sticking can damage the pipe, the wellbore, and the hydrocarbon reservoir.

SUMMARY

Implementations of the present disclosure include a drill pipe assembly that includes a first drill pipe disposed in a wellbore. The first drill pipe includes a tubular wall and a threaded end at a downhole end of the tubular wall. The drill pipe assembly also includes a second drill pipe disposed in the wellbore downhole of and fluidically coupled to the first drill pipe. The second drill pipe includes a tubular wall and a threaded end corresponding with and configured to receive the threaded end of the first drill pipe to form a connection. At least one of the first drill pipe or the second drill pipe includes an annular groove residing between a respective tubular wall and a respective threaded end. The drill pipe assembly is collapsible at the annular groove under a torque smaller than a torque required to collapse the connection.

In some implementations, the annular groove includes an external annular groove at the first drill pipe. The tubular wall of the first drill pipe includes an external surface and the annular groove resides between the external surface and the threaded end of the first drill pipe. In some implementations, the annular groove is adjacent the threaded end of the first drill pipe and the threaded end of the second drill pipe includes a tapped hole configured such that, with the connection formed, the second drill pipe covers the annular groove of the first drill pipe. In some implementations, the first drill pipe includes a wall thickness at the annular groove smaller than a wall thickness of the first drill pipe at the tubular wall.

In some implementations, the drill pipe assembly is part of a drill string extending from a surface of the wellbore to a downhole end of the drill string, and the drill string is collapsible at the annular groove under a torque smaller than a torque required to collapse any connection or section of the drill string. In some implementations, the drill string is configured to collapse at the annular groove under a torque that is about between 13% and 20% less than a required torque to break a next weakest link or portion of the drill string.

In some implementations, the annular groove includes, in side view, a U-shaped cross section that includes a width of about between 0.35 and 0.7 inches, and a wall thickness of about between 0.3 and 0.5 inches.

In some implementations, the threaded end of the first drill pipe includes external threads and the threaded end of the second drill pipe includes internal threads. In some implementations, the tubular wall of the first drill pipe includes a substantially uniform outer diameter and inner diameter and the threaded end of the first drill pipe is tapered toward the second pipe, the internal threads of the second pipe are tapered in a corresponding direction with respect to the first drill pipe to be threadedly attached to the first drill pipe, and the tubular wall of the second drill pipe includes an outer diameter and inner diameter substantially equal to the outer diameter and the inner diameter of the first drill pipe, respectively.

In some implementations, the connection and the annular groove reside uphole of a bottom hole assembly (BHA) coupled to the drill pipe assembly.

Implementations of the present disclosure also include a pipe assembly that includes a first pipe and a second pipe. The first pipe is configured to be disposed in a wellbore and includes a coupling end. The second pipe is configured to be disposed in the wellbore and includes a coupling end configured to be attached to the coupling end of the first pipe to form a connection. At least one of the first pipe or the second pipe includes a groove. The pipe assembly is collapsible at the groove under a torque smaller than a torque required to collapse the connection.

In some implementations, the groove includes an external annular groove at the first pipe. The first pipe includes an external surface and the annular groove resides between the external surface and the coupling end of the first pipe. In some implementations, the annular groove is adjacent the coupling end of the first pipe and the coupling end of the second pipe includes a rim that, with the connection formed, extends beyond the coupling end of the first pipe and covers the annular groove of the first pipe.

In some implementations, the pipe assembly is part of a drill string extending from a surface of the wellbore to a downhole end of the drill string. The drill string is collapsible at the annular groove under a torque smaller than a torque required to collapse any connection or section of the drill string. In some implementations, the drill string is configured to collapse at the annular groove under a torque that is about between 13% and 20% less than a torque required to break a next weakest link or portion of the drill string.

In some implementations, the annular groove includes, in side view, a U-shaped cross section that includes a width of about between 0.35 and 0.7 inches, and a wall thickness of about between 0.3 and 0.5 inches.

In some implementations, the coupling end of the first pipe includes external threads and the coupling end of the second pipe includes internal threads. The first pipe includes a substantially uniform inner diameter and the second pipe includes an inner diameter substantially equal the inner diameter of the first pipe. The first pipe and the second pipe are configured to flow drilling fluid across the connection substantially uninterruptedly. In some implementations, the connection and the annular groove reside uphole of a bottom hole assembly (BHA) coupled to the pipe assembly.

Implementations of the present disclosure include a method that includes drilling a wellbore with a drill string. The drill string includes a first drill pipe that includes a tubular wall and a threaded end at a downhole end of the tubular wall. The drill string also includes a second drill pipe disposed downhole of and fluidically coupled to the first drill pipe. The second drill pipe includes a tubular wall and a threaded end attached to the threaded end of the first drill pipe forming a connection with the first drill pipe. At least one of the first drill pipe or the second drill pipe includes an annular groove residing between a respective tubular wall and a respective threaded end. The drill pipe assembly is collapsible at the annular groove under a torque smaller than a torque required to collapse the connection. The method also includes determining that the drill string is stuck in the wellbore. The method also includes applying torque the to the drill string to tighten the first drill pipe to the second drill pipe until the drill string collapses at the annular groove, and retrieving the first drill pipe from the wellbore.

In some implementations, applying torque to the drill string includes applying, from a surface of the wellbore, a torque of about between 13% and 20% less than a required torque to break a next weakest link or portion of the drill string.

DETAILED DESCRIPTION OF THE DISCLOSURE

The present disclosure describes a drill pipe assembly that allows a portion of a stuck drill string to be released and retrieved from a wellbore. The drill pipe assembly includes a first drill pipe with an annular groove and a second drill pipe attached to the first drill pipe. By applying torque (for example, applying torque from or near a surface of the wellbore) to the first drill pipe, the annular groove of the drill pipe breaks or collapses to disconnect the first drill pipe from the stuck portion of the drill string. The annular groove is designed such that torque applied to tighten the first drill pipe to the second drill pipe causes the first drill pipe to break at the annular groove before any other link or component of the drill string breaks.

Particular implementations of the subject matter described in this specification can be implemented so as to realize one or more of the following advantages. For example, a portion of a stuck drill string can be quickly retrieved from a wellbore without using expensive tools (for example, cutting tools), saving time and resources as well as decreasing shutdown time. Oil and gas drilling is one of the most (if not the most) complex and costly operations in the energy sector. Freeing a stuck drill pipe quickly in an emergency scenario can significantly save resources and prevent damage in the formations and in the reservoir. The tubular pipe link disclosed in the present disclosure can be used in off-shore and onshore applications, and in conventional and unconventional drilling. The drill pipe with an annular groove disclosed in the present disclosure can be implemented in existing drill pipes or utilized with new drill pipes.

Figure 1:
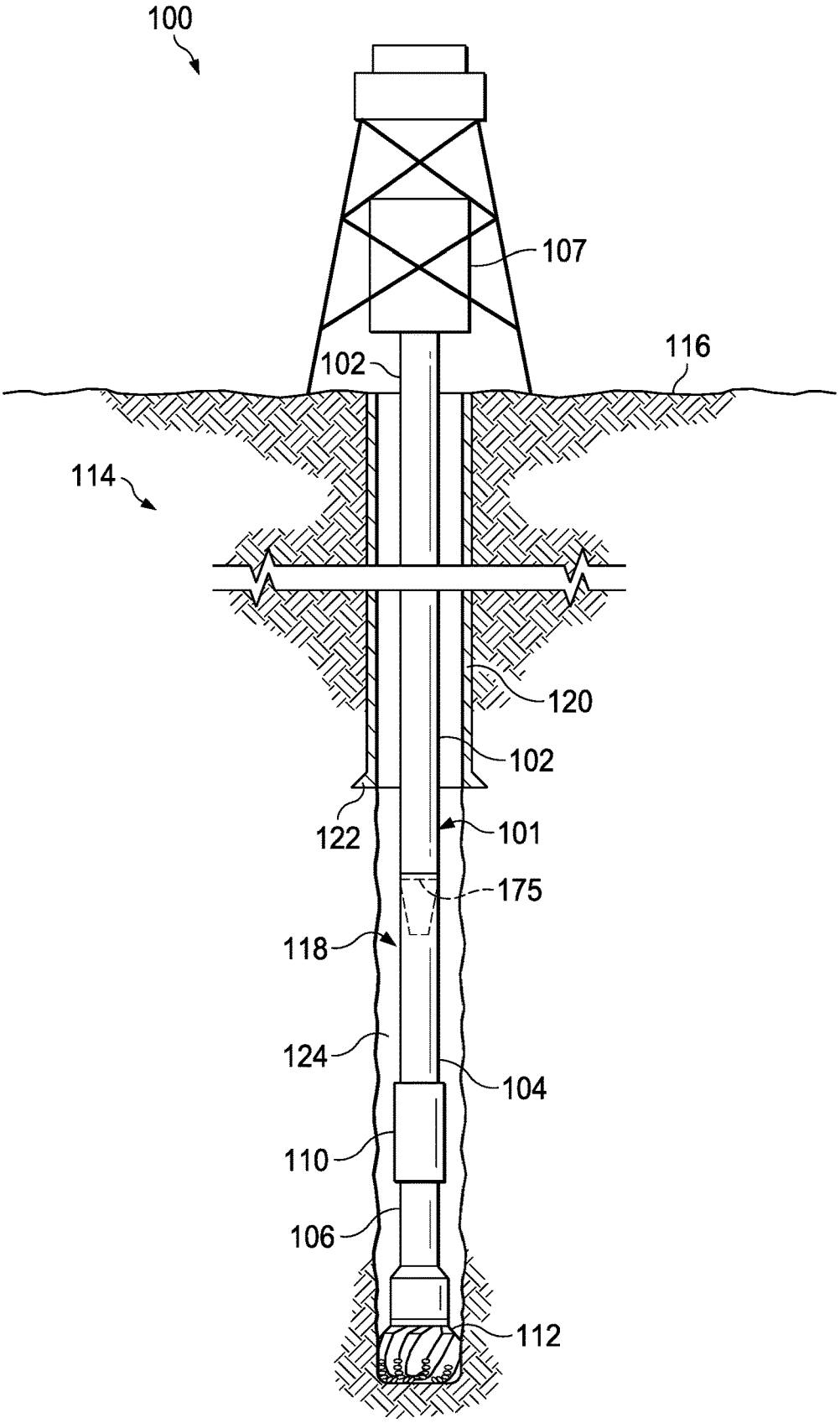
FIG. 1 is a front schematic view of a wellbore tool assembly disposed in a wellbore.

FIG. 1 shows a wellbore tool assembly 100 that includes a drill pipe assembly 118 and a bottom hole assembly 110 (BHA). The drill pipe assembly 118 and the BHA 110 can be part of a drill string 101 used to drill a wellbore 114. The wellbore 114 extends from a surface 116 of the wellbore 114 to a downhole end of the wellbore 114. The drill string 101 can be attached to a top drive 107 that applies torque to the drill string 101 from the surface 116. The drill pipe assembly 118 is disposed in the wellbore 114 and includes a first drill pipe 102 and a second drill pipe 104. The wellbore 114 can include a cased portion and an open-hole portion. In some implementations, the wellbore 114 can be uncased, including only an open-hole portion. The cased portion includes a casing 120 with an end 122 (for example, at the casing depth) at a downhole location of the wellbore 114. The wellbore 114 includes an open hole 124 downhole of the casing end 122 where part or all of the wellbore tool assembly 100 is disposed. The drill string 101 includes a drill bit 112 that can be part of the BHA 110 or be disposed downhole of the BHA 110.

As further described in detail later with respect to FIGS. 4 and 5, the first drill pipe 102, the second drill pipe 104, or both include a groove 175 (e.g., an annular groove) at which the drill pipe assembly 118 can break. Under a stuck pipe condition, the first drill pipe 102 is decoupled from the second drill pipe 104 to retrieve the first drill pipe 102 from the wellbore 114.

Figure 2:
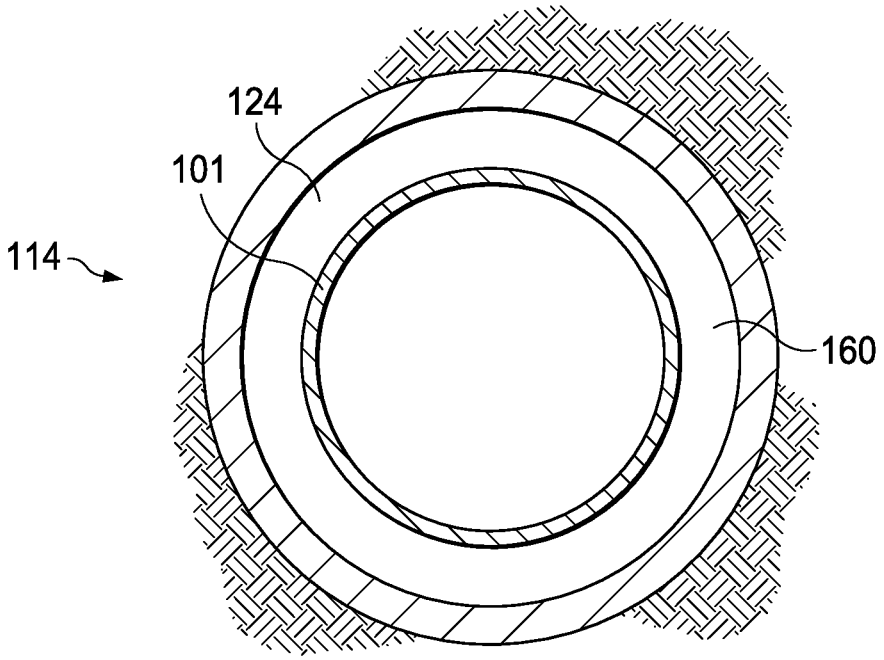
FIG. 2 is a top schematic view, cross-sectional, of a drill string in a wellbore under normal conditions.
Figure 3:
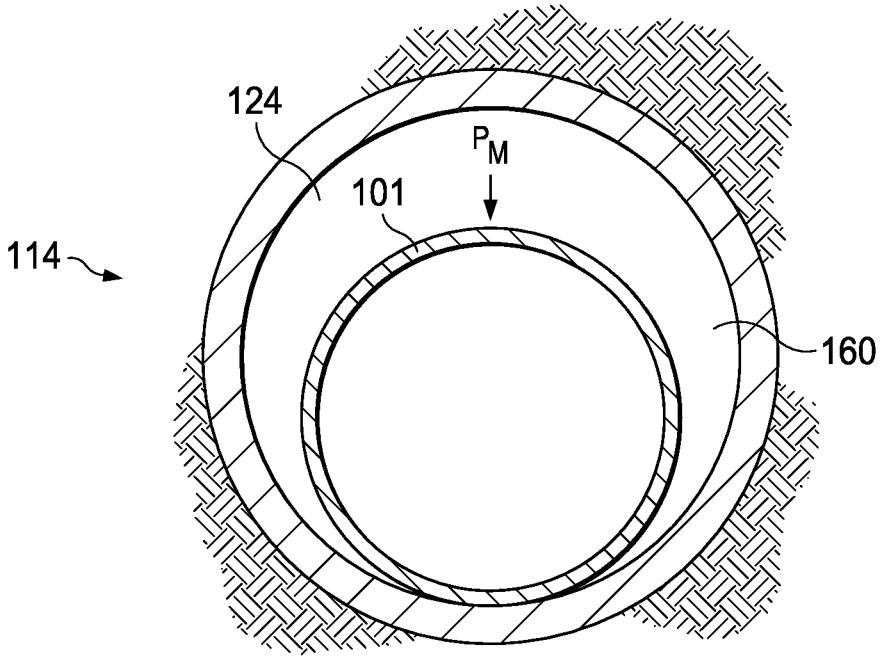
FIG. 3 is a top schematic view, cross-sectional, of the drill string in the wellbore of FIG. 2, under a pipe stuck condition.

FIGS. 2 and 3 show a top, cross-sectional view of a normal wellbore condition and a stuck pipe condition, respectively. Referring to FIG. 2, the drill string 101 is disposed in the wellbore 114 (for example, in the open hole 124 portion of the wellbore) and forms a generally uniform or constant annulus 160 with the wellbore 114. Under normal conditions, the drill string 101 is able to move generally freely along the wellbore 114. As shown in FIG. 3, under certain conditions, the drill string 101 can get stuck in the wellbore 114. For example, the sticking can be caused by differential sticking, mechanical sticking, or other type of sticking. Mechanical sticking may be caused by borehole instabilities, such as caving, sloughing, or collapse. FIG. 3 shows an example of a differential sticking condition. In differential sticking, the pressure '$P_M$' in the annulus 160 exceeds the pressure of the formation, causing the drill string 101 (for example, a portion of the drill string such as the second pipe downhole of the first pipe) to move against the wall of the wellbore 114, embedding the drill string 101 in the wall or a filter cake of the wellbore 114. The internal filter cake pressure decreases to a point in which the drill string 101 contacts the filter cake, causing the pipe to be held against the wall of the wellbore 114 by differential pressure. In high-angle and horizontal wellbores, gravitational force contributes to extended contact between the drill string 101 and the formation or the wall of the wellbore 114.

Figure 4:
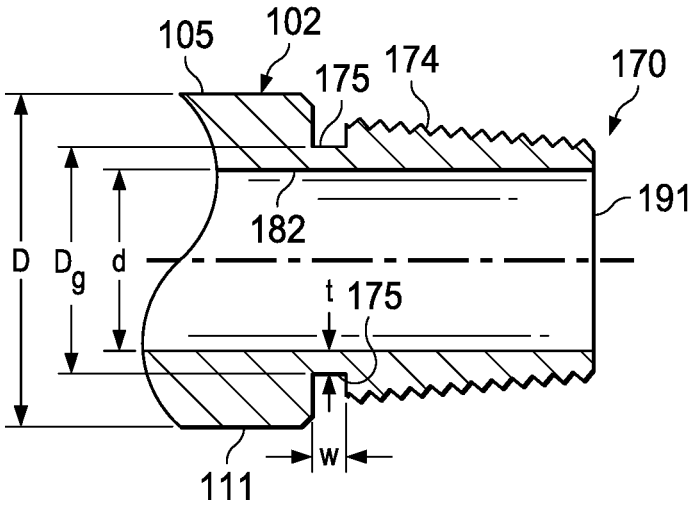
FIG. 4 is a side cross-sectional view of a portion of a first drill pipe.
Figure 5:
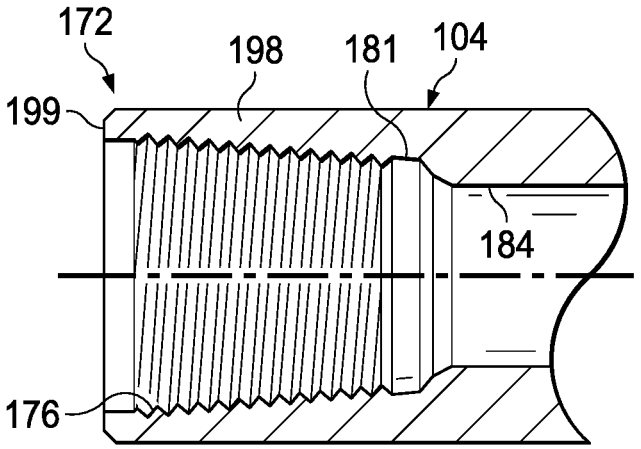
FIG. 5 is a side cross-sectional view of a portion of a second drill pipe.

FIGS. 4 and 5 show a portion of the first drill pipe 102 and a portion of second drill pipe 104, respectively. The first drill pipe 102 threadedly connects to the second drill pipe 104 to form a connection. As shown in FIG. 4, the first drill pipe 102 has a tubular wall 105 and a coupling end 174 (e.g., a threaded end) at a downhole end 170 of the tubular wall 105. The first drill pipe 102 has an external annular groove 175 (e.g., a groove along the circumference of the pipe 102) at which the first drill pipe 102 can break under tightening torque. The annular groove 175 resides between the threaded end 174 and the tubular wall 105. The annular groove 175 can be adjacent the threaded end 174 of the first drill pipe 102. For example, the groove 175 is disposed between an external surface 111 of the tubular wall 105 and a first thread of the threaded end 174.

The first drill pipe 102 has a wall thickness 't' at the annular groove 175 smaller than a wall thickness of the first drill pipe 102 at the tubular wall 105. The dimensions of the annular groove 175 with respect to the drill string 101 allows the drill string 101 to collapse at the groove 175 under a torque smaller than a torque required to collapse any connection or section of the drill string 101. For example, the annular groove can have, in side view, a U-shaped cross section with a width 'w' of about between 0.35 and 0.7 inches (e.g., 0.5 inches), and a wall thickness 't' of about between 0.3 and 0.5 inches (e.g., 0.405 inches).

The external annular groove 175 does not change the inner diameter 'd' of the first drill pipe 102. For example, the bore of the first drill pipe 102 has a generally constant inner diameter 'd' across the length of the first drill pipe 102. The bore of the second drill pipe 104 has a generally constant inner dimeter similar to the inner diameter of the first drill pipe 102 such that, when fluidically coupled, the drilling fluid flows generally uninterruptedly across the connection between the first drill pipe 102 and the second drill pipe 104. Thus, the groove 175 reduces the cross sectional area of the pipe 102 at the groove 175 without reducing the inner diameter of the pipe 102. The tubular wall 105 of the first pipe 102 has a substantially constant outer diameter 'D' up to the groove 175. For example, the outer diameter 'D' can be about between 4.5 and 5 inches (e.g., 4.75 inches) and the inner diameter 'd' can be about between 2.65 and 2.8 (e.g., 2.69 inches). The groove 175 can have an outer diameter '$D_g$' of about between 3.2 and 3.7 inches (e.g., 3.5 inches).

The annular groove 175 creates a weak point in the drill string 101 at which the drill string 101 is collapsible under a tightening torque smaller than a tightening torque required to break a next weakest point of the drill string 101. For example, if the second drill pipe 104 (or a portion of the drill string below the second pipe 104) is stuck in the wellbore, an operator can rotate the drill string 101 in a tightening direction (e.g., in a direction to tighten the threaded connections of the drill string 101) until the drill string breaks at the groove 175 to disconnect the unstuck portion of the drill string 101 (including the remaining portion of the first drill pipe 102) from the stuck portion of the drill string 101. The torque required to break the drill string 101 at the groove 175 can be about 13% to 20% less (e.g., 15% less) than a required torque to break the next weakest link or portion of the drill string 101. For example, if the next weakest point of the drill string 101 is the threaded connection between the first drill pipe 102 and the second drill pipe 104, and a torque of about 10,608 pound-feet is necessary to break such connection, the annular groove can be broken with a torque of between 8,500 and 9,200 pound-feet (e.g., 9,016 pound-feet). However, the torque necessary to disconnect the first drill pipe 102 from the second drill pipe 102 may depend on several reasons such as depth, length of drill pipe, size of drill pipe, and type of formation.

By the groove 175 being collapsible it is meant that the wall (e.g., at the cross sectional area of the groove) of the first drill pipe 102 at the groove 175 plastically deforms, under a certain torsional torque, to release the first drill pipe 102 from the threaded end 174 of the first drill pipe, which remains connected to the second drill pipe 104. By 'collapsible' it is meant that the wall at the groove 175 breaks due to external force applied to the first drill pipe 102, undoing the connection between the first drill pipe 102 and the second drill pipe 104.

Figure 6:
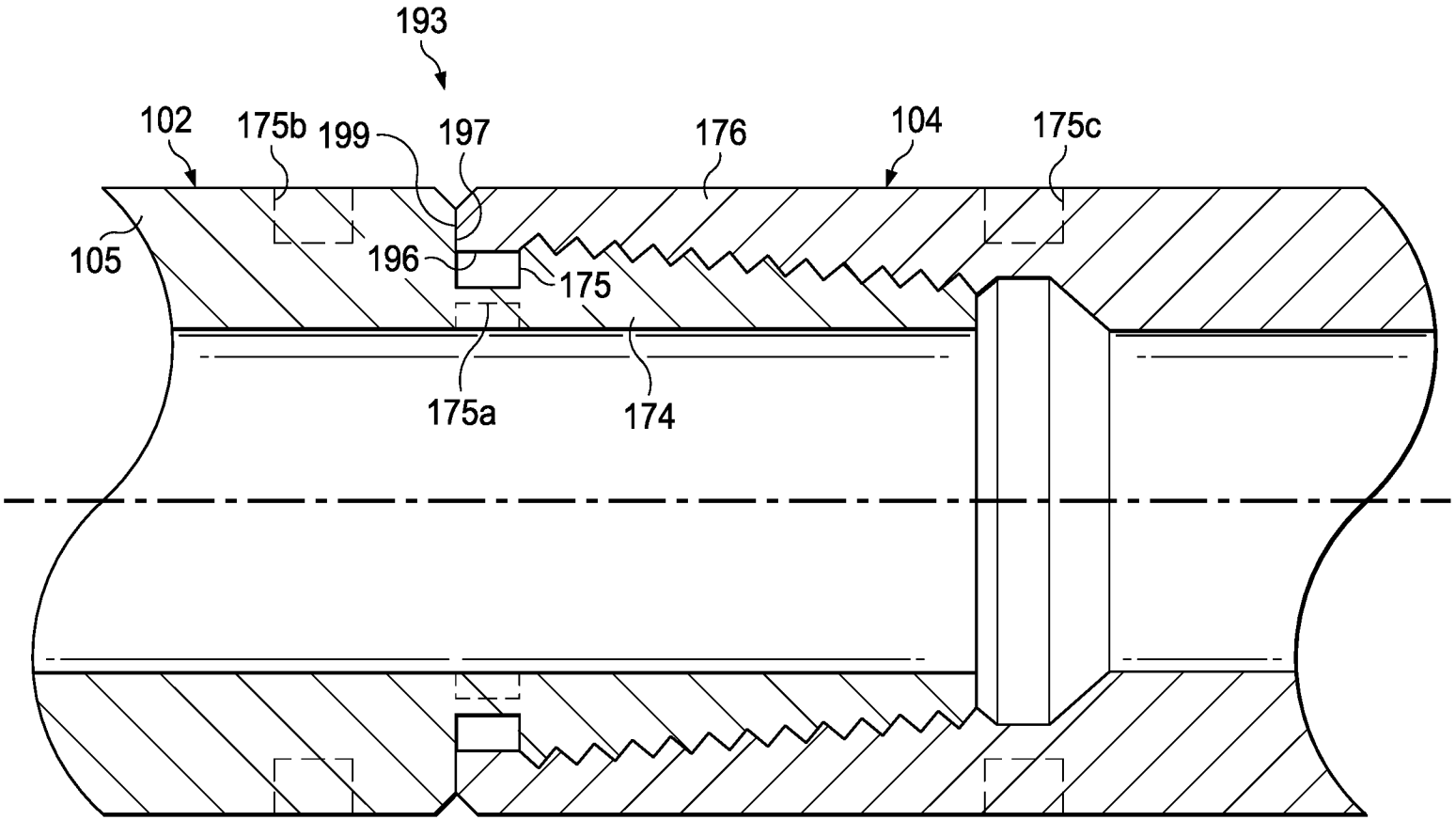
FIG. 6 is a side cross-sectional view of the first drill pipe connected to the second drill pipe.

Referring to FIG. 5, the second drill pipe 104 is disposed in the wellbore downhole of and is fluidically coupled to the first drill pipe 102. The second drill pipe 104 has a tubular wall 198 and a coupling end 176 (e.g., a threaded end) at an end 172 of the tubular wall 198. The threaded end 176 corresponds with the threaded end 174 of the first drill pipe 102 and receives the threaded end 174 of the first drill pipe 102 to form a connection (as shown in FIG. 6). The threaded end 174 of the first drill pipe 102 has external threads and the threaded end 176 of the second drill pipe 104 has internal threads.

Referring to FIGS. 4 and 5, the threaded end 170 of the first drill pipe 102 can be tapered toward an outlet 191 of the first drill pipe 102 (e.g., toward the second pipe 104) and the threaded end 172 of the second pipe 102 can be tapered in a corresponding opposite direction with respect to the first drill pipe 102 to be threadedly attached to the first drill pipe 102. When the connection is formed, the outer diameters of the first drill pipe 102 and the second drill pipe 104 are substantially equal. Additionally, the inner diameter 'd' of the bore 182 or internal surface of the first pipe 102 is substantially equal to an inner diameter of the second drill pipe 104 to allow fluid to flow across the threaded connection generally uninterruptedly.

Referring to FIG. 6, the first drill pipe 102 forms the threaded connection 193 with the second drill pipe 104. With the connection 193 formed, an end 196 of the second pipe 104 covers from view the annular groove 175 of the first drill pipe 102. For example, the annular groove 175 is adjacent or next to the coupling end 174 of the first pipe 102 so that the a rim 199 at an the end 196 of the second pipe 104 extends beyond the coupling end 174 of the first pipe 102. The rim 199 of the second pipe 104 can contact a shoulder 197 of the first pipe 102. In other words, the coupling end 176 of the second drill pipe 104 includes a tapped hole that allows the coupling end 174 to be inserted into the second tube 104 far enough so that, with the connection 193 formed, the second drill pipe 104 covers the annular groove 175 of the first drill pipe 102. The first drill pipe 102 (and by extension the drill string) is collapsible at the annular groove 175 under a torque smaller than a torque required to collapse the connection 193 and any connection of the drill string. Thus, the point at the groove 175 is the weakest point of the drill string under torsional torque.

The annular groove can also reside in a different location of the first drill pipe 102 or the second drill pipe 104. For example, as shown in dashed lines, the annular groove **175*a* can be an internal groove, extending from the internal surface of the first pipe 102. The annular groove 175*b* can also reside at a location along the tubular wall 105, spaced from the threaded end 174. Lastly, the annular groove 175*c* can reside at the second drill pipe 104 and can be an external groove (as shown in FIG. 6) or internal groove (e.g., extending from the internal surface of the second pipe 104**).

Figure 7:
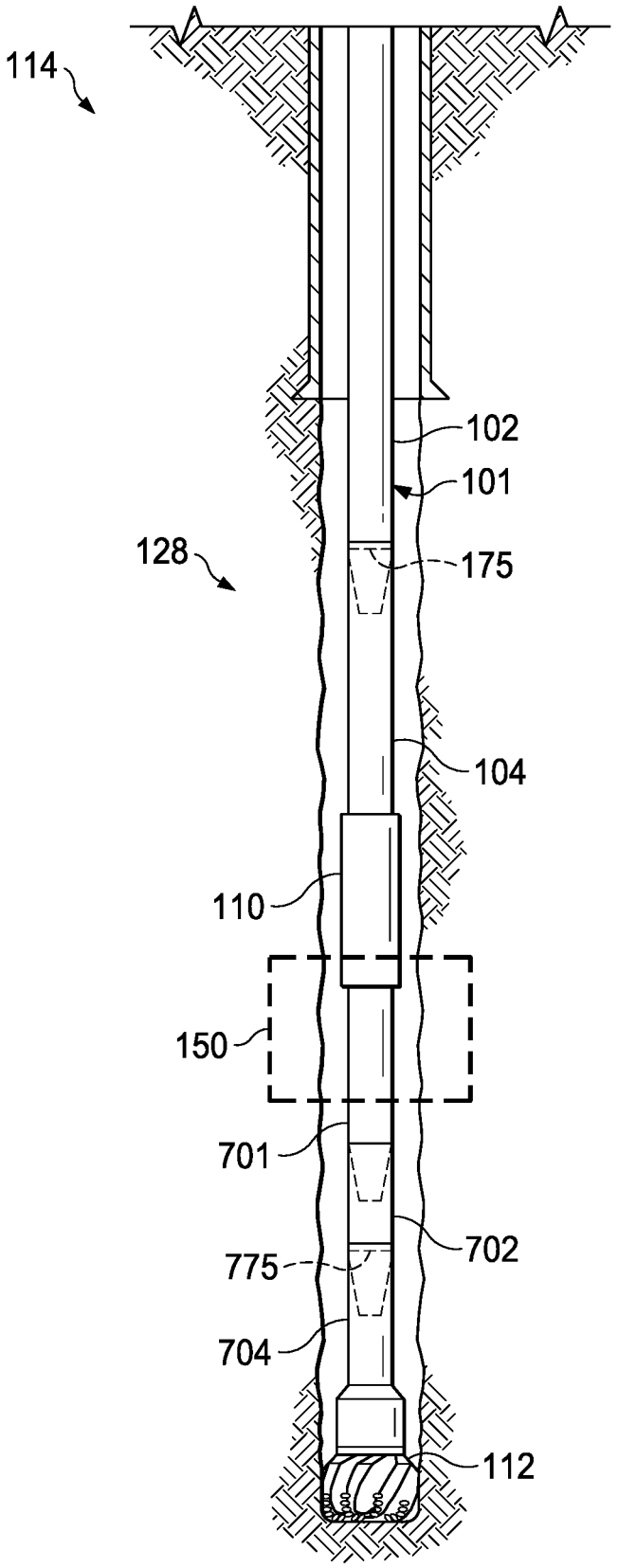
FIG. 7 is a front schematic view of a wellbore tool assembly according to an implementation.

FIG. 7 shows an implementation of a drill string 101 that includes a wellbore tool assembly 128 with a bottom hole assembly (BHA) 110. The wellbore tool assembly 128 includes the first drill pipe 102 and the second drill pipe 104 deployed in the wellbore 114. The first drill pipe has the annular groove 175. The wellbore tool assembly 128 also includes a third drill pipe 701, a fourth drill pipe 702, and a fifth drill pipe 705, each disposed downhole of the BHA 110. The fourth drill pipe 702 can be a short pipe that acts as a link between the third drill pipe 701 and the fifth drill pipe 704. Similar to the first drill pipe 102, the fourth drill pipe 702 can include an annular groove 775. The BHA can include drill collars and subs such as stabilizers, reamers, shocks, and hole-openers.

The wellbore tool assembly 128 can be configured to satisfy certain wellbore or engineering requirements depending on a location 150 of a potential risk of sticking in the wellbore 114. Specifically, the groove 175 can be disposed above the BHA 110 in an exploration well to prevent damaging the hydrocarbon reservoir, and the groove 775 can be disposed under the BHA 110 in a known field (for example, in a wellbore where the statistics or parameters can be identified from offset wells). The tubular pipe link 108 is preferably disposed at a location different than the location 150 of potential risk.

The wellbore tool assembly 128 can include one annular groove, two annular grooves, or more depending on the conditions of the wellbore 114. For example, the tool assembly 128 can have two grooves 175 and 775, each disposed on one side of the BHA 110 to allow the drill string to separate from above or below the BHA 110 during a stuck pipe situation. For example, in drilling a 10,000 ft wellbore in an unknown formation with a potential of having a pipe stuck condition at a depth of between 8,000 ft and 8,500 ft, the wellbore tool assembly 128 can have two grooves 175 and 775. One groove 175 is disposed uphole of the BHA 110 at around 6,000 ft and the groove 775 is disposed downhole of the BHA 110 at around 9,000 ft. Thus, the wellbore tool assembly 128 allows the pipe to be released from under or above the sticking zone. The second groove 775 can be configured to break under a torque lower than a torque required to break the first groove 175. The second groove 775 can be located in or below the potential stuck zone 150 such that in a stuck condition, the drill pipe has a chance of disconnecting from fifth drill pipe 704 to save the BHA 110. However, if the drill pipe fails to disconnect from the fifth drill pipe 704, the drill pipe will still be freed from the second drill pipe 104.

Figure 8:
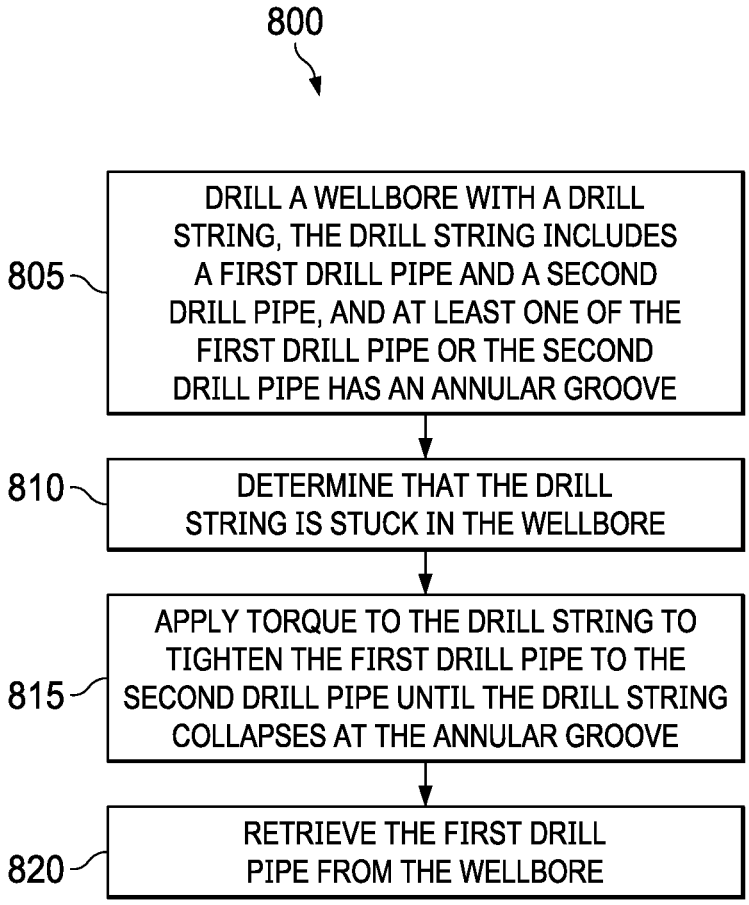
FIG. 8 is a flow chart of an example method of retrieving a stuck pipe from a wellbore.

FIG. 8 is a flow chart of an example method (800) of retrieving a stuck pipe from a wellbore. The method includes drilling a wellbore with a drill string. The drill string includes a first drill pipe that includes a tubular wall and a threaded end at a downhole end of the tubular wall. The drill string also includes a second drill pipe disposed downhole of and fluidically coupled to the first drill pipe. The second drill pipe includes a tubular wall and a threaded end attached to the threaded end of the first drill pipe, forming a connection with the first drill pipe. At least one of the first drill pipe or the second drill pipe has an annular groove residing between a respective tubular wall and a respective threaded end. The drill pipe assembly is collapsible at the annular groove under a torque smaller than a torque required to collapse the connection (805). The method also includes determining that the drill string is stuck in the wellbore (810). The method also includes applying torque the to the drill string to tighten the first drill pipe to the second drill pipe until the drill string collapses at the annular groove (815), and retrieving the first drill pipe from the wellbore (820).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used herein, the terms "substantially equal," "substantially uniform," and similar variations refer to a relation between two elements (e.g., lines, axes, planes, surfaces, or components) as being machined to have the same dimensions within acceptable engineering, machining, drawing measurement, or part size tolerances such that the elements.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A drill pipe assembly comprising:

a first drill pipe configured to be disposed in a wellbore, the first drill pipe comprising a tubular wall and a threaded end at a downhole end of the tubular wall, wherein the threaded end of the first drill pipe comprises external threads; and a second drill pipe configured to be disposed in the wellbore downhole of and fluidically coupled to the first drill pipe, the second drill pipe comprising a tubular wall and a threaded end corresponding with and configured to receive the threaded end of the first drill pipe to form a connection, wherein the threaded end of the second drill pipe comprises internal threads;

wherein the second drill pipe comprises an annular groove residing on an external surface of the tubular wall of the second drill pipe, the drill pipe assembly collapsible at the annular groove under a torque smaller than a torque required to collapse the connection; wherein the annular groove comprises, in side view, a U-shaped cross section comprising a width of between 0.35 and 0.7 inches, and a wall thickness of between 0.3 and 0.5 inches.

2. The drill pipe assembly of claim 1, wherein the threaded end of the second drill pipe comprises a tapped hole configured to form the connection with the external threads of the first drill pipe.

3. The drill pipe assembly of claim 1, wherein the second drill pipe comprises a wall thickness at the annular groove smaller than a wall thickness of the second drill pipe at the tubular wall of the second drill pipe.

4. The drill pipe assembly of claim 1, wherein the drill pipe assembly is part of a drill string extending from a surface of the wellbore to a downhole end of the drill string, and the drill string is collapsible at the annular groove under a torque smaller than a torque required to collapse any connection or section of the drill string.

5. The drill pipe assembly of claim 1, wherein the tubular wall of the first drill pipe comprises a uniform outer diameter and inner diameter and the threaded end of the first drill pipe is tapered toward the second pipe, the internal threads of the second pipe are tapered in a corresponding direction with respect to the first drill pipe to be threadedly attached to the first drill pipe, and the tubular wall of the second drill pipe comprises an outer diameter and inner diameter equal to the outer diameter and the inner diameter of the first drill pipe, respectively.

6. The drill pipe assembly of claim 1, wherein the connection and the annular groove reside uphole of a bottom hole assembly (BHA) coupled to the drill pipe assembly.

7. A pipe assembly comprising:

a first pipe configured to be disposed in a wellbore, the first pipe comprising a coupling end having external threads; and a second pipe configured to be disposed in the wellbore and comprising a coupling end configured to be attached to the coupling end of the first pipe to form a connection, wherein the coupling end of the second pipe has internal threads;

wherein the second pipe comprises an external annular groove formed on an external surface of the second pipe, the pipe assembly collapsible at the groove under a torque smaller than a torque required to collapse the connection; wherein the groove comprises, in side view, a U-shaped cross section comprising a width of between 0.35 and 0.7 inches, and a wall thickness of between 0.3 and 0.5 inches.

8. The pipe assembly of claim 7, wherein the coupling end of the second pipe comprises a rim that, with the connection formed, is set apart from the external annular groove.

9. The pipe assembly of claim 7, wherein the pipe assembly is part of a drill string extending from a surface of the wellbore to a downhole end of the drill string, and the drill string is collapsible at the groove under a torque smaller than a torque required to collapse any connection or section of the drill string.

10. The pipe assembly of claim 7, wherein the first pipe comprising a uniform inner diameter and the second pipe comprises an inner diameter equal the inner diameter of the first pipe, the first pipe and second pipe configured to flow drilling fluid across the connection uninterruptedly.

11. The pipe assembly of claim 7, wherein the connection and the groove reside uphole of a bottom hole assembly (BHA) coupled to the pipe assembly.

12. A method comprising:

drilling a wellbore with a drill string, the drill string comprising:

a first drill pipe comprising a tubular wall and a threaded end at a downhole end of the tubular wall, wherein the threaded end of the first drill pipe comprises external threads, and a second drill pipe disposed downhole of and fluidically coupled to the first drill pipe, the second drill pipe comprising a tubular wall and a threaded end attached to the threaded end of the first drill pipe forming a connection with the first drill pipe, wherein the threaded end of the second drill pipe comprises internal threads, wherein the second drill pipe comprises an annular groove residing on an external surface of the tubular wall of the second drill pipe, the drill string collapsible at the annular groove under a torque smaller than a torque required to collapse the connection;

determining that the drill string is stuck in the wellbore;

applying torque the to the drill string to tighten the first drill pipe to the second drill pipe until the drill string collapses at the annular groove; and retrieving the first drill pipe from the wellbore.

* * * * *